US005280234A

United States Patent [19]

Huang et al.

[11] Patent Number: 5,280,234

[45] Date of Patent: Jan. 18, 1994

[54] VOLTAGE REGULATOR CIRCUIT

[75] Inventors: Joel Huang; Youngweon Kim, both of Suwon, Rep. of Korea

[73] Assignee: Samsung Electronics Co., Ltd., Rep. of Korea

[21] Appl. No.: 816,110

[22] Filed: Jan. 2, 1992

[30] Foreign Application Priority Data

Jul. 3, 1991 [KR] Rep. of Korea ..... 91-11271

[51] Int. Cl.[5] ..... G05F 3/16

[52] U.S. Cl. ..... 323/313; 307/296.8

[58] Field of Search ..... 323/312, 313, 314, 299; 307/296.1, 296.8

[56] References Cited

U.S. PATENT DOCUMENTS

| | | | |
|---|---|---|---|
| 4,300,061 | 11/1981 | Mihalich et al. | 323/313 |
| 4,641,081 | 2/1987 | Sato et al. | 323/313 |
| 4,694,199 | 9/1987 | Goetz | 307/297 |
| 4,868,484 | 9/1989 | Seo et al. | 323/314 |
| 5,008,609 | 4/1991 | Fakiage | 323/313 |
| 5,029,283 | 7/1991 | Ellsworth et al. | 307/475 |
| 5,086,238 | 2/1992 | Watanabe et al. | 307/296.6 |
| 5,150,188 | 9/1992 | Hara et al. | 357/41 |
| 5,160,858 | 11/1992 | Kataoka et al. | 307/450 |
| 5,187,429 | 2/1993 | Phillips | 323/314 |
| 5,212,440 | 5/1993 | Waller | 323/313 |

OTHER PUBLICATIONS

IBM Disclosure Bulletin, 811974, vol. 17, No. 3, p. 937.

*Primary Examiner*—Steven L. Stephan
*Assistant Examiner*—B. Davidson
*Attorney, Agent, or Firm*—Clifford A. Poff

[57] ABSTRACT

A voltage regulator circuit includes a variable resistance formed by diode configuration of NMOS depletion transistors connected in a parallel relation with a supply voltage divider connected at a node by a further variable resistance formed by a serial arrangement of NMOS transistors with ground and having each of their gates coupled to the supply voltage.

4 Claims, 1 Drawing Sheet

VOLTAGE REGULATOR CIRCUIT

BACKGROUND OF THE INVENTION (1) Field of the Invention

The present invention relates to a voltage regulator circuit for providing a constant output voltage at its output terminal particularly when a change to the input voltage occurs within a predetermined range of the voltage fluxiation.

(2) Description of The Prior Art

As is well known, voltage regulators are used to meet the requirement for a constant output voltage by a power supply regardless of an input voltage or load variations. The voltage regulator is usually in the form of a device connected with the output of a power supply to maintain the output voltage at a rated value. The regulator is usually required to act automatically to compensate for changes that occur in the operation of the circuit.

A conventional voltage regulator circuit is illustrated schematically in FIGS. 1A and 1B and includes a plurality of N-type metal-oxide-transistors(MOS) connected in series each having its gate connected to a drain between a supply Vcc and ground such that an output voltage Vo is obtained at a node na of NMOS transistor. According to this voltage regulator circuit, because NMOS transistors are in diode configuration, the output voltage Vo of the circuit is increased proportionally as the supply voltage Vcc is increased as shown in a graph of the relationship between a supply voltage and an output voltage in the circuit of FIG. 1B.

Another conventional voltage regulator circuit is illustrated schematically in FIG. 2A and is an improvement to the conventional voltage regulator circuit shown in FIG. 1A. In a manner similar to voltage regulator of FIG. 1A, NMOS transistors are connected in series and each has its gate connected to its drain but the series connection is between a voltage supply Vcc and node na. A variable resistor is effectively formed by NMOS transistors having a supply voltage Vcc supplied to their gates while serially connected between node and ground. This use of NMOS transistors as a variable resistor enables operation of the voltage regulators such that when the supply voltage Vcc increases, there is a reduction to the resistance by the NMOS transistors serially connected between Vo and Vcc. The output voltage Vo can decrease in proportion to an increase of the supply voltage Vcc. In the voltage regulator circuit of FIG. 2A, the output voltage characteristic is improved as compared to the conventional voltage regulator circuit of FIG. 1A, but the output voltage Vo still increases in response to an increasing supply voltage Vcc as depicted by the graph line of FIG. 2B.

Accordingly, an object of the present invention is to provide an improved voltage regulator circuit for providing a constant output voltage, even when there are changes to the input supply voltage Vcc.

SUMMARY OF THE INVENTION

In accordance with the present invention there is provided a voltage regulator circuit for an input voltage, the circuit comprising: a supply voltage divider means including NMOS transistors each having its gate connected to its drain, first variable resistor means including NMOS transistors each having its gate connected to the input voltage, the NMOS transistors of the first variable resistor means being in series and connecting the supply voltage divider means with ground for providing a constant output voltage at a node of the supply voltage divider means and the first variable resistor means, second variable means operating parallel with the supply voltage divider means and coupled between the node and the input voltage for providing a stabilized output voltage.

According to a further feature of the present invention, a voltage regulator circuit for an input voltage includes supply voltage divider means supplied by the input voltage for providing a plurality of divided voltage supplies, first variable resistor means controlled by the input voltage while serially connected between one of the divided voltage supplies and ground for providing a constant output voltage at a node, and second variable means coupled to receive a second of the divided voltage supplies to operate parallel between the node and the input voltage for providing a stabilizing output voltage.

BRIEF DESCRIPTION OF THE DRAWINGS

The present invention will be better understood when read in light of the accompanying drawings in which.

DETAILED DESCRIPTION OF THE PREFERRED EMBODIMENTS

Figure 1A:
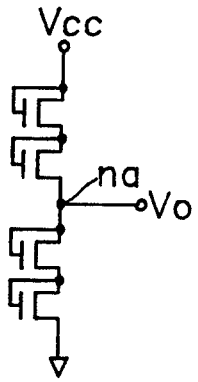
FIG. 1A (Prior Art)
FIG. 1A is a circuit diagram of a conventional voltage regulator circuit.
Figure 1B:
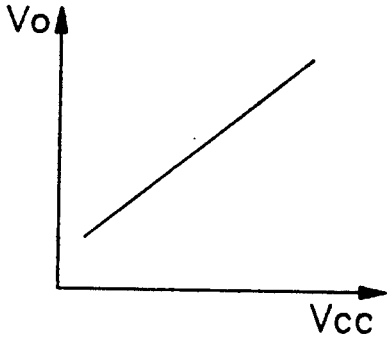
FIG. 1B (Prior Art)
FIG. 1B is a graph illustrating the relationship between supply voltage and an output voltage according to the operation of the circuit shown in FIG. 1A.
Figure 2A:
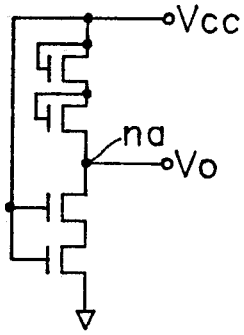
FIG. 2A (Prior Art)
FIG. 2A is a circuit diagram of a second conventional voltage regulator circuit.
Figure 2B:
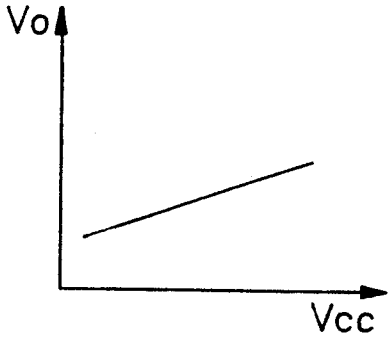
FIG. 2B (Prior Art)
FIG. 2B is a graph illustrating the relationship between supply voltage and an output voltage according to the operation of the circuit shown in FIG. 2A.
Figure 3A:
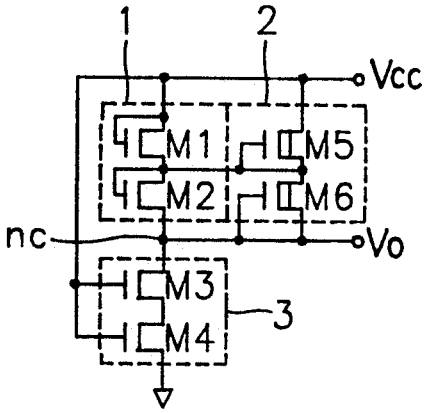
FIG. 3A is a circuit diagram of a voltage regulator circuit according to the present invention.

In FIG. 3A there is illustrated in a circuit diagram of a preferred embodiment of a voltage regulator circuit according to the present invention. The circuit as shown includes means forming a supply voltage divider 1 and includes NMOS transistors $M_1$ and $M_2$ connected in series. Transistors $M_1$ and $M_2$ have their respective gates connected to their drains for dividing a supply voltage Vcc which is an input voltage. The voltage divider 1 produces voltage supplies.

A first variable resistor means 3 includes NMOS transistors $M_3$ and $M_4$ having each of their gates coupled to one of the supply voltage. In the circuit of FIG. 3A, the first variable resistor means 3 is connected in series between one divided voltage supply of the voltage divider 1 and ground. A second variable means 2 is connected to the supply voltage divider 1 between the first variable resistor means 3 and Vcc for stabilizing an output voltage. The second variable resistor means 2 includes transistors $M_5$ and $M_6$. These transistors are diode connected NMOS depletion transistors each having a connecting point by which control is provided by the connections to a connecting point of the MOS transistors $M_1$ and $M_2$ as shown forming parts of the divided voltage supplies by supply voltage divider 1.

The operation of the voltage regulator circuit of FIG. 3A will now be described in response to an event when the level of supply voltage increases due to surge voltage or a transient voltage. The voltage corresponding to the increase to the supply voltage is divided by the NMOS transistors $M_1$ and $M_2$ such that the voltage at node nc is increased which results in increase to the output voltage Vo. Now the voltage difference between each drain and source of the NMOS depletion transistors $M_5$ and $M_6$ becomes large, and the resistance value becomes high and therefore, the output voltage Vo is reduced.

In the even of a reduction to the power supply voltage Vcc, the voltage regulator circuit of the present invention operates by providing that as the voltage difference between each drain and source of the NMOS depletion transistors $M_5$ and $M_6$ becomes smaller so also does resistance value become lower and therefore, the voltage output Vo increases by the amount by which the power supply voltage Vcc decreases whereby the compensation occurs by rising the output voltage.

Figure 3B:
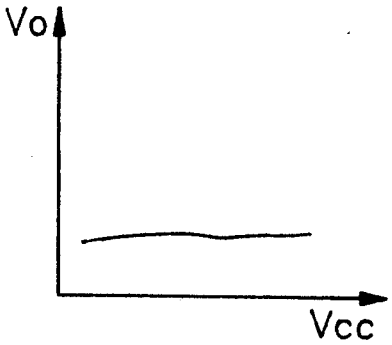
FIG. 3B is a graph illustrating the relationship between supply voltage and an output voltage according to the operation of the circuit shown in FIG. 3A.

Accordingly, as shown in FIG. 3B, the output voltage Vo is maintained at a constant voltage level, notwithstanding changes to the magnitude of input supply voltage Vcc.

When utilizing the circuit of the present invention, the level of constant output voltage can be controlled by changing the number of the transistors connected in the manner as described regarding NMOS transistors $M_1$ and $M_2$; $M_3$ and $M_4$; and $M_5$ and $M_6$ forming respectively the supply voltage divider 1, the first variable resistor means 3 and the second variable resistor means 2. It will be understood, however, that as the number of the NMOS transistors $M_1$ and $M_2$ and NMOS depletion transistors $M_5$ and $M_6$ is increased, the constant output voltage can be at a low voltage range.

on the other hand, as the number of the NMOS transistors $M_3$ and $M_4$ is increased, the constant output voltage can be at a high voltage range.

When the voltage regulator of the present invention is used in a main power supply to form power supplies for two circuits, then even if the output voltage of any one of two power supplies increases, the voltage regulation by the other circuit thereof is not affected whereby the present invention is applicable to various high voltage circuits.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A voltage regulator circuit for an input voltage, said circuit comprising:

supply voltage divider means including first and second NMOS transistors, each having its gate connected to its drain;

first variable resistor means including third and fourth NMOS transistors, each having its gate connected to said input voltage, said third and fourth NMOS transistors of said first variable resistor means being connected in series and connecting said supply voltage divider means with ground for providing a constant output voltage at a node between said supply voltage divider means and said first variable resistor means; and second variable resistor means for providing a stabilized output voltage and including fifth and sixth NMOS transistors, said fifth NMOS transistor having its gate and drain connected between said first and second NMOS transistors, said sixth NMOS transistor having its gate and drain connected between said supply voltage divider means and said first variable resistor means.

2. The voltage regulator circuit according to claim 1, wherein each of said fifth and sixth NMOS transistors comprises a depletion type transistor.

3. A voltage regulator circuit for an input voltage said circuit comprising;

supply voltage divider means including first and second transistors supplied by said input voltage for providing a plurality of divided voltage supplies;

first variable resistor means controlled by said input voltage while serially connected between one of said divided voltage supplies and ground for providing a constant output voltage at a node; and second variable resistor means for providing a stabilized output voltage, said second variable resistor means including fifth and sixth transistors, said fifth transistor having its gate and drain connected between said first and second transistors, said sixth transistor having its gate and drain connected between said supply voltage divider means and said first variable resistor means.

4. The voltage regulator circuit according to claim 3 wherein said fifth and sixth transistors are each NMOS transistors.

* * * * *